US010459390B2

(12) United States Patent
Takahashi

(10) Patent No.: US 10,459,390 B2
(45) Date of Patent: Oct. 29, 2019

(54) IMAGE FORMING APPARATUS HAVING REDUCED SENSITIVITY TO LEAK LIGHT AND CONTROL METHOD OF IMAGE FORMING APPARATUS

(71) Applicant: CANON KABUSHIKI KAISHA, Tokyo (JP)

(72) Inventor: Shun Takahashi, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/728,699

(22) Filed: Oct. 10, 2017

(65) Prior Publication Data

US 2018/0113407 A1 Apr. 26, 2018

(30) Foreign Application Priority Data

Oct. 20, 2016 (JP) ..... 2016-206276

(51) Int. Cl.
*G03G 15/00* (2006.01)

(52) U.S. Cl.
CPC ..... *G03G 15/5054* (2013.01)

(58) Field of Classification Search
CPC ..... G03G 15/5054
See application file for complete search history.

(56) References Cited

U.S. PATENT DOCUMENTS 4,553,033 A * 11/1985 Hubble, III ..... G01N 21/55 250/341.8
4,796,065 A * 1/1989 Kanbayashi ..... A23C 11/08 399/60
4,989,985 A * 2/1991 Hubble, III ..... G01N 21/55 250/341.8
9,116,489 B2 * 8/2015 Nakagawa ..... G03G 15/5062
9,513,170 B2 * 12/2016 Kita ..... G01J 3/501
9,971,293 B2 * 5/2018 Monden ..... G03G 15/5058
2003/0059178 A1 * 3/2003 Kobayashi ..... G02B 6/4206 385/94

(Continued)

FOREIGN PATENT DOCUMENTS

JP 2002268314 A * 9/2002
JP 2008209821 A 9/2008

*Primary Examiner* — Sevan A Aydin
(74) *Attorney, Agent, or Firm* — Rossi, Kimms & McDowell LLP

(57) ABSTRACT

Provided is an image forming apparatus configured to detect an image density while suppressing a change in sensitivity characteristic of an optical sensor, which is caused by leak light. The image forming apparatus includes the optical sensor configured to measure a measurement image formed on an intermediate transfer belt, and output a detected analog value indicating a measurement result, and a controller. The optical sensor includes a light emitting element and a light receiving element. The controller includes a memory configured to store profile data regarding a driving current of the light emitting element and an amount of leak light directly received by the light receiving element from the light emitting element. The controller is configured to detect the amount of leak light corresponding to the driving current of the light emitting element at a time of measurement of the measurement image based on the profile data.

11 Claims, 9 Drawing Sheets

(56) References Cited

U.S. PATENT DOCUMENTS

| | | | | |
|---|---|---|---|---|
| 2008/0292360 | A1* | 11/2008 | Hirai | G01J 1/04 399/220 |
| 2009/0095881 | A1* | 4/2009 | Funakubo | G01J 1/24 250/205 |
| 2011/0204233 | A1* | 8/2011 | Costello | G01S 7/4813 250/338.4 |
| 2011/0222892 | A1* | 9/2011 | Hashiguchi | G03G 15/161 399/74 |
| 2013/0259510 | A1* | 10/2013 | Regelsberger | G03G 15/5062 399/74 |
| 2013/0272740 | A1* | 10/2013 | Nakagawa | G01N 21/55 399/74 |
| 2015/0211992 | A1* | 7/2015 | Ishizumi | G01N 21/55 399/49 |
| 2016/0170325 | A1* | 6/2016 | Nagashima | G01N 21/474 399/74 |
| 2017/0131670 | A1* | 5/2017 | Ino | G03G 15/0178 |
| 2017/0153569 | A1* | 6/2017 | Nagashima | G01N 21/474 |

* cited by examiner

IMAGE FORMING APPARATUS HAVING REDUCED SENSITIVITY TO LEAK LIGHT AND CONTROL METHOD OF IMAGE FORMING APPARATUS

BACKGROUND OF THE INVENTION

Field of the Invention

The present invention relates to an electrophotographic image forming apparatus, such as a copying machine or a printer.

Description of the Related Art

An electrophotographic image forming apparatus has a function of measuring a measurement image formed on an image bearing member with an optical sensor including a light emitting element and a light receiving element, and of appropriately adjusting density of an image to be formed by the image forming apparatus based on a measurement result of the measurement image. The optical sensor is configured to regularly adjust a driving current of the light emitting element with respect to a toner soil and a change with time of the light emitting element such that a detected value, which is the measurement result, is controlled to be kept constant within a predetermined range (Japanese Patent Application Laid-open No. 2008-209821). When a toner adhesion amount (image density) of the measurement image on the image bearing member is changed, an amount of reflected light from the image bearing member is changed. The optical sensor is configured to measure the change in amount of reflected light from the image bearing member, which is changed with the image density of the measurement image. In order to adjust an amount of light of the light emitting element, the optical sensor has the driving current of the light emitting element adjusted. The driving current of the light emitting element is adjusted such that the detected value of the image bearing member portion falls within the predetermined range. The optical sensor has the driving current of the light emitting element adjusted after a printing operation on a predetermined number of pages or on startup, to thereby suppress the effect of the change in amount of light of the light emitting element caused by the toner soil and the change with time on the measurement result.

A surface-mounted optical sensor, in which the light emitting element and the light receiving element are mounted on one substrate, can be downsized and reduced in cost. The light emitting element and the light receiving element for surface mounting are directly mounted on a surface of the substrate, and hence are difficult to adopt the structure of being encapsulated with a resin as in a round light emitting diode. Therefore, irradiation light from the light emitting element may be propagated on the surface of the substrate, and enter an inner layer of the substrate to reach the light receiving element. Such light reaching the light receiving element from the light emitting element is referred to as "leak light". An amount of leak light varies for individual optical sensors due to variations in part tolerances and assembly accuracy.

When the optical sensor in which the leak light occurs is controlled such that the detected value, which is the measurement result, is kept constant within the predetermined range, the individual differences of the optical sensors do not occur in the detected value of the image bearing member portion. However, with the optical sensor in which the leak light occurs, when the image density of the measurement image is increased, the individual differences of the optical sensors occur in the detected value due to the effect of the amount of leak light. Therefore, the detected value has a high output offset and a large variation. Moreover, experiments have shown that the amount of leak light is increased when the driving current of the light emitting element is increased or an output gain of the light receiving element is increased to suppress the effect of the toner soil in addition to the individual differences of the optical sensors. Therefore, the optical sensor may be changed in characteristics with the increase in the amount of leak light. As described above, the optical sensor is increased in individual differences of sensitivity characteristics by the amount of leak light, and is changed in sensitivity characteristics every time the driving current of the light emitting element is adjusted or the output gain of the light receiving element is switched. The change in sensitivity characteristics of the optical sensor makes it difficult to accurately measure the image density, and hinders accurate density correction. As a result, quality of the image formed by the image forming apparatus is reduced. In view of the above, it is an object of the present invention to detect an image density with high accuracy while suppressing a change in sensitivity characteristics of an optical sensor, which is caused by leak light.

SUMMARY OF THE INVENTION

The image forming apparatus according to the present invention includes: an image forming unit configured to form an image on a sheet; a transfer member, onto which a measurement image is to be transferred; a sensor, including a substrate, a light emitting element, which is provided on the substrate, a light receiving element, which is provided on the substrate, and a shielding member, which is provided between the light emitting element and the light receiving element on the substrate, and configured to output measurement data based on a light receiving result from the light receiving element; an adjustment unit configured to control the image forming unit to form the measurement image, control the sensor to measure reflected light from the measurement image based on a measurement condition, and adjust an image forming condition based on correction data and measurement data corresponding to a light receiving result of the reflected light from the measurement image; a determination unit configured to control the sensor to receive reflected light from the transfer member, determine the measurement condition based on another measurement data corresponding to a light receiving result of reflected light from the transfer member, and determine the correction data corresponding to the measurement condition.

Further features of the present invention will become apparent from the following description of exemplary embodiments (with reference to the attached drawings).

DESCRIPTION OF THE EMBODIMENTS

In the following, a description is given in detail of an embodiment of the present invention with reference to the drawings.

Configuration

Figure 1:
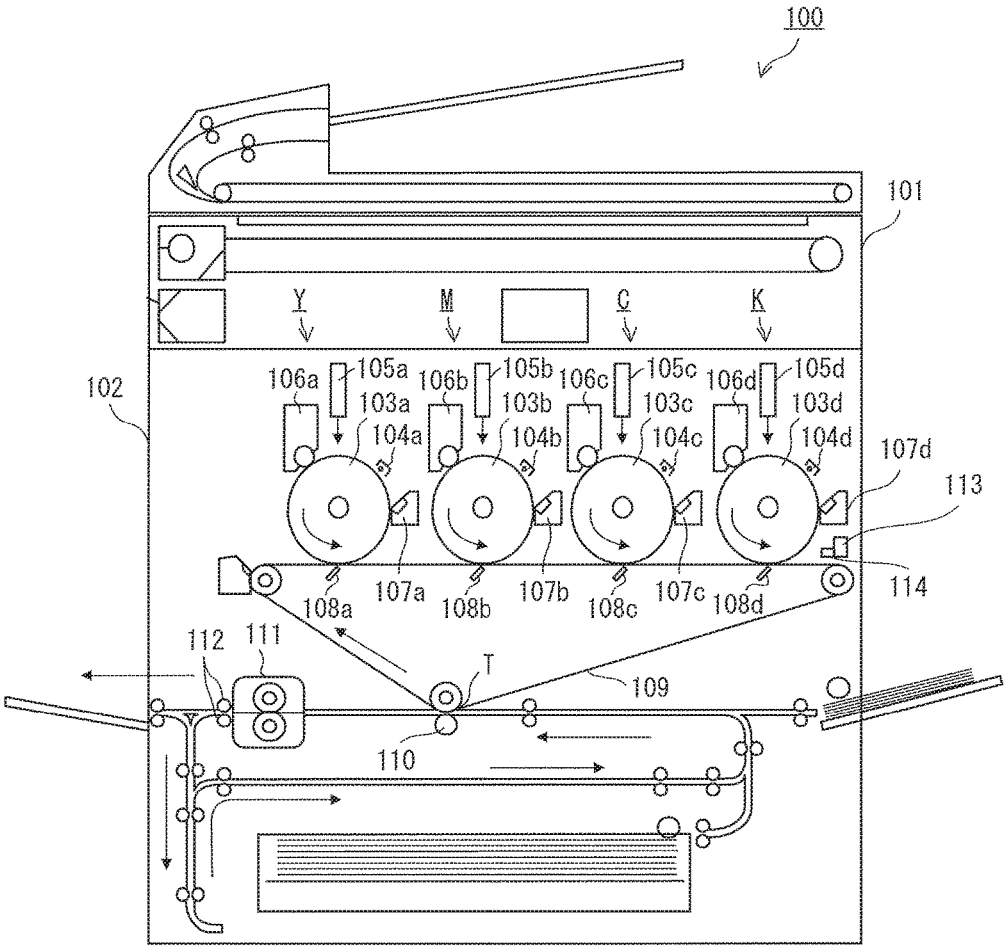
FIG. 1 is a configuration diagram of an image forming apparatus.

FIG. 1 is a configuration diagram of an image forming apparatus 100 according to this embodiment. The image forming apparatus 100 is an electrophotographic full-color printer. The image forming apparatus 100 includes a reader 101 and a printer 102. The reader 101 is a scanner, for example, and is configured to generate image data based on an original image read from an original. The printer 102 is configured to form an image on a recording medium, for example, a sheet, based on the image data generated by the reader 101.

The printer 102 includes image forming stations Y, M, C, and K for forming toner images of respective colors, namely, yellow (Y), magenta (M), cyan (C), and black (K). The respective image forming stations Y, M, C, and K have the same configuration, and are different from one another only in that those image forming stations form toner images of different colors.

The image forming station Y is a drum-shaped photosensitive member, and includes a photosensitive drum 103*a* serving as an image bearing member configured to bear a yellow toner image. A charging device 104*a*, an exposing device 105*a*, a developing device 106*a*, and a cleaner 107*a* are arranged around the photosensitive drum 103*a*. The charging device 104*a* is configured to charge the surface of the photosensitive drum 103*a*. The exposing device 105*a* is configured to expose the surface of the charged photosensitive drum 103*a* with laser light that is modulated based on yellow image data to form an electrostatic latent image on the photosensitive drum 103*a*. The developing device 106*a* is configured to develop the electrostatic latent image with a yellow toner to form a yellow toner image on the photosensitive drum 103*a*. The cleaner 107*a* is configured to clean toner remaining on the photosensitive drum 103*a* after the toner image is transferred onto an intermediate transfer belt 109 described later.

The image forming station M includes a photosensitive drum 103*b*, a charging device 104*b*, an exposing device 105*b*, a developing device 106*b*, and a cleaner 107*b*. The image forming station M is configured to form a magenta toner image on the photosensitive drum 103*b*. The image forming station C includes a photosensitive drum 103*c*, a charging device 104*c*, an exposing device 105*c*, a developing device 106*c*, and a cleaner 107*c*. The image forming station C is configured to form a cyan toner image on the photosensitive drum 103*c*. The image forming station K includes a photosensitive drum 103*d*, a charging device 104*d*, an exposing device 105*d*, a developing device 106*d*, and a cleaner 107*d*. The image forming station K is configured to form a black toner image on the photosensitive drum 103*d*.

The intermediate transfer belt 109, which is configured to bear a full-color toner image after toner images of respective colors formed on the photosensitive drums 103*a* to 103*d* are transferred thereon, is provided under the image forming stations Y, M, C, and K. The intermediate transfer belt 109 is also an example of an image bearing member. Transfer blades 108*a* to 108*d* are arranged opposite to the photosensitive drums 103*a* to 103*d*, respectively, across the intermediate transfer belt 109.

The yellow toner image formed on the photosensitive drum 103*a* is transferred onto the intermediate transfer belt 109 by a transfer bias applied to the transfer blade 108*a*. The magenta toner image formed on the photosensitive drum 103*b* is transferred onto the intermediate transfer belt 109 by a transfer bias applied to the transfer blade 108*b*. The cyan toner image formed on the photosensitive drum 103*c* is transferred onto the intermediate transfer belt 109 by a transfer bias applied to the transfer blade 108*c*. The black toner image formed on the photosensitive drum 103*d* is transferred onto the intermediate transfer belt 109 by a transfer bias applied to the transfer blade 108*d*. As a result, toner images of respective colors are formed on the intermediate transfer belt 109.

The intermediate transfer belt 109 is configured to form a transfer nip portion T between the intermediate transfer belt 109 and a transfer roller 110. The intermediate transfer belt 109 rotates in the clockwise direction in FIG. 1, to thereby convey the toner images transferred from the respective photosensitive drums 103*a* to 103*d* to the transfer nip portion T. A recording medium is conveyed to the transfer nip portion T in synchronization with the timing at which the toner image is conveyed. The recording medium is conveyed between the intermediate transfer belt 109 and the transfer roller 110, and the toner images of respective colors are collectively transferred from the intermediate transfer belt 109 onto the recording medium.

A fixing device 111 is provided on a downstream side in the conveying direction of the recording medium. The fixing device 111 is configured to fix a toner image to the recording medium onto which the toner image is transferred. For example, the fixing device 111 heats and pressurizes the recording medium to fix the toner image to the recording medium. The recording medium having the toner image fixed thereon is discharged from the fixing device 111 to the outside of the image forming apparatus 100 by discharge rollers 112 or the like.

The image forming station K for forming a black toner image is provided nearer to the transfer nip portion T in the rotation direction of the intermediate transfer belt 109 than the other image forming stations Y, M and C for chromatic colors are. With such an arrangement, when a monochrome image is formed, a period of time from an image formation instruction to discharge of the recording medium on which the image is formed is suppressed.

An optical sensor 113 and a thermistor 114 are provided nearer to the transfer nip portion T than the image forming station K is in the rotation direction of the intermediate transfer belt 109. The optical sensor 113 is configured to detect an image density of a measurement image, which is a toner image for density correction formed on the intermediate transfer belt 109. The thermistor 114 is a temperature sensor configured to detect a temperature around the optical sensor 113.

Exposing Device

Figure 2:
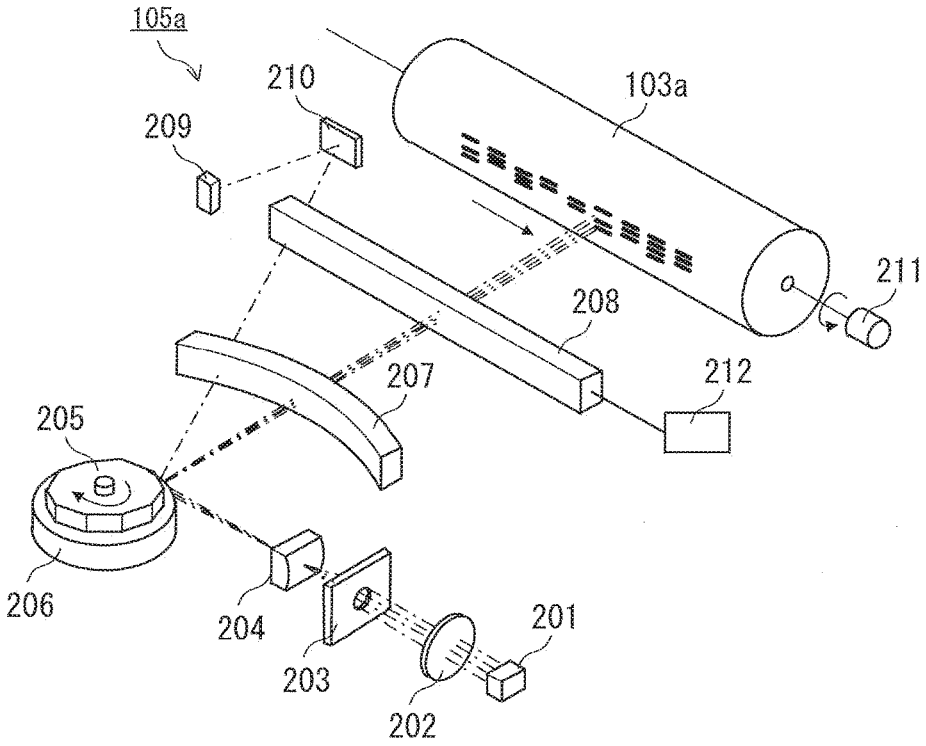
FIG. 2 is an explanatory view of an exposure device.

FIG. 2 is an explanatory diagram of the exposing device 105*a*. The exposing device 105*a* and the exposing devices 105*b*, 105*c*, and 105*d* have the same configuration. Now, the exposing device 105*a* is described, and the description of the exposing devices 105*b*, 105*c*, and 105*d* is omitted here.

The exposing device 105*a* includes a semiconductor laser 201 serving as a light source, a collimator lens 202, an aperture stop 203, a cylindrical lens 204, a rotary polygon mirror 205, a rotary polygon mirror driving unit 206, a toric lens 207, and a diffractive optical element 208. Further, the exposing device 105*a* includes a reflection mirror 210 and a beam detector 209 in order to control the timing to scan the photosensitive drum 103*a* by laser light.

The collimator lens 202 is configured to convert laser light emitted from the semiconductor laser 201 into a parallel light flux. The aperture stop 203 is configured to limit the light flux of the passing laser light. The cylindrical lens 204 has a predetermined refractive power only in a sub scanning direction, which is perpendicular to a main scanning direction in which the laser light scans the photosensitive drum 103*a*. The cylindrical lens 204 is configured to form an image of the light flux having passed through the aperture stop 203 as an elliptical image elongated in the main scanning direction on the reflecting surface of the rotary polygon mirror 205. The rotary polygon mirror 205 is rotated at a constant speed in the clockwise direction in FIG. 2 by the rotary polygon mirror driving unit 206, and deflects the laser light imaged on the reflecting surface toward the photosensitive drum 103*a*. The toric lens 207 is an optical element having an fθ characteristic, and has different refractive indices in the main scanning direction and the sub-scanning direction. Both front and rear lens surfaces in the main scanning direction of the toric lens 207 are aspheric. The diffractive optical element 208 is an optical element having an fθ characteristic, and has different magnifications in the main scanning direction and the sub-scanning direction.

The reflection mirror 210 is provided outside of an image forming region of the photosensitive drum 103*a*. The reflection mirror 210 is configured to reflect the laser light reflected by the rotary polygon mirror 205 toward the beam detector 209. The beam detector 209 detects laser light reflected by the reflection mirror 210 to output a scanning timing signal for instructing the position at which the scanning of the photosensitive drum 103*a* is to be started.

The photosensitive drum 103*a* is driven to rotate about the drum axis by a drum driving unit 211. The photosensitive drum 103*a* is irradiated with laser light as the spot of the laser light deflected by the rotary polygon mirror 205 being driven to rotate moves linearly in accordance with the rotation of the rotary polygon mirror 205 with the direction parallel to the drum axis as the main scanning direction. As a result, an electrostatic latent image is formed on the photosensitive drum 103*a* in the main scanning direction. The surface of the photosensitive drum 103*a* is charged by the charging device 104*a*, and the potential of the portion irradiated with the laser light changes to become an electrostatic latent image. The semiconductor laser 201 of this embodiment is a multi-beam laser configured to emit a plurality of laser light beams. Thus, a plurality of line-like electrostatic latent images are formed on the photosensitive drum 103*a* by one scanning operation. The photosensitive drum 103*a* is rotationally driven by the drum driving unit 211, and thus an electrostatic latent image is formed in the sub scanning direction.

The diffractive optical element 208 is a rectangular box extending in the same direction as the drum axis of the photosensitive drum 103*a*, and is rotatable about its longitudinal direction by a diffractive optical element driving unit 212. The rotation of the diffractive optical element 208 corrects the direction of the scanning line on the photosensitive drum 103*a* (inclination of the scanning line with respect to the drum axis of the photosensitive drum 103*a*) and the curvature.

Controller

Figure 3:
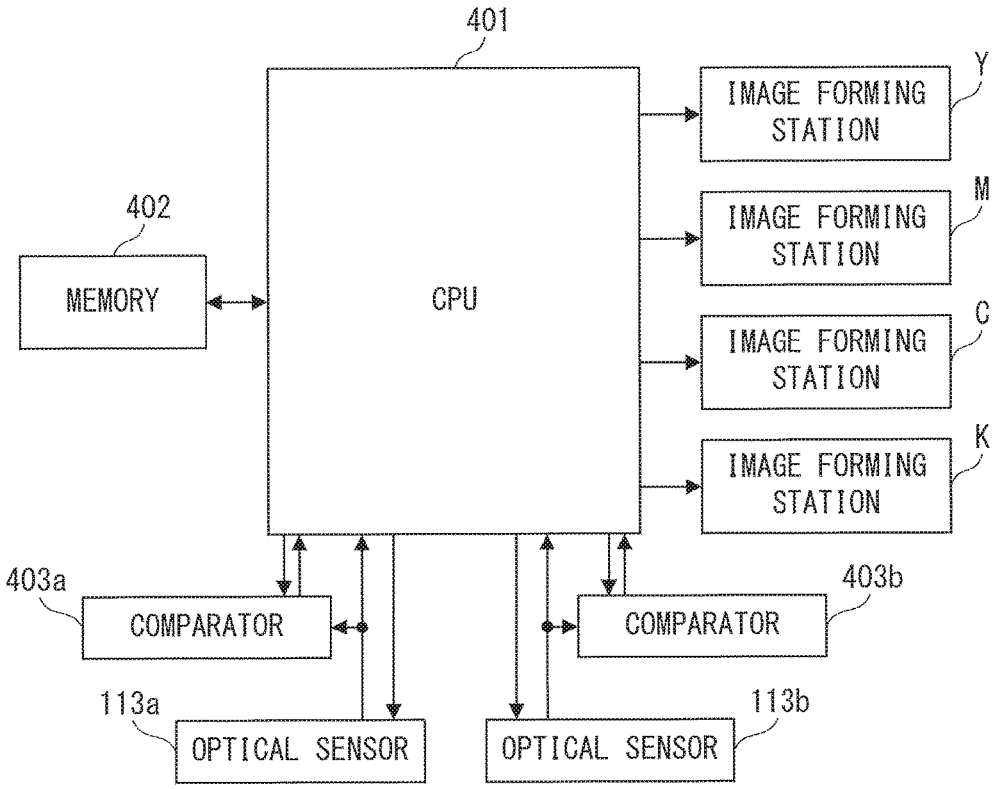
FIG. 3 is a configuration diagram of a controller.

FIG. 3 is a configuration diagram of a controller configured to control operation of the image forming apparatus 100. The controller is included in the image forming apparatus 100, and is configured to perform control for forming the image. Here, a configuration of the controller for performing density correction is described. The controller includes a central processing unit (CPU) 401, a memory 402, and comparators 403*a* and 403*b*. The CPU 401 is configured to control the operation of the image forming apparatus 100 by reading and executing a predetermined computer program from the memory 402. The controller is formed of a discrete component, or is implemented by a one-chip semiconductor product, for example. Examples of the one-chip semiconductor product include a micro-processing unit (MPU), an application specific integrated circuit (ASIC), and a system-on-a-chip (SOC). In this embodiment, the CPU 401 is configured to perform density correction control by executing a computer program. Moreover, here, there is described an example in which the measurement image is measured by two optical sensors 113*a* and 113*b*. The two optical sensors 113*a* and 113*b* are provided at the position of the optical sensor 113 in FIG. 1 and at different positions in a direction perpendicular to the conveying direction of the toner image on the intermediate transfer belt 109, for example.

Although described later in detail, each of the optical sensors 113*a* and 113*b* is configured to irradiate the intermediate transfer belt 109, and to output, as a measurement result, a detected value (detected analog value), which is an analog signal corresponding to an intensity (amount) of light reflected thereby. The detected analog value output from the optical sensor 113*a* is input to the CPU 401 and the comparator 403*a*. The comparator 403*a* is configured to convert the acquired detected analog value into a detected digital value, which is a digital signal, and to input the detected digital value to the CPU 401. The detected analog value output from the optical sensor 113*b* is input to the CPU 401 and the comparator 403*b*. The comparator 403*b* is configured to convert the acquired detected analog value into a detected digital value, and to input the detected digital value to the CPU 401. The optical sensor 113*a* and the optical sensor 113*b* have the same configuration. The comparator 403*a* and the comparator 403*b* have the same configuration. In the following, in order to simplify the description, the optical sensors 113*a* and 113*b* are described as the optical sensor 113, and the comparators 403*a* and 403*b* are described as a comparator 403.

The CPU 401 is configured to adjust an amount of light with which the optical sensor 113 irradiates the intermediate transfer belt 109 such that the detected analog value acquired from the optical sensor 113 becomes a predetermined value. The amount of light adjustment control is described later in detail. The CPU 401 is configured to detect image densities of measurement images of the respective colors based on the detected digital value acquired from the comparator 403. The CPU 401 is configured to perform density correction control of the respective colors based on the detected image densities. The CPU 401 is configured to transmit a signal for the density correction to each of the image forming stations Y, M, C, and K.

Optical Sensor

Figure 4A:
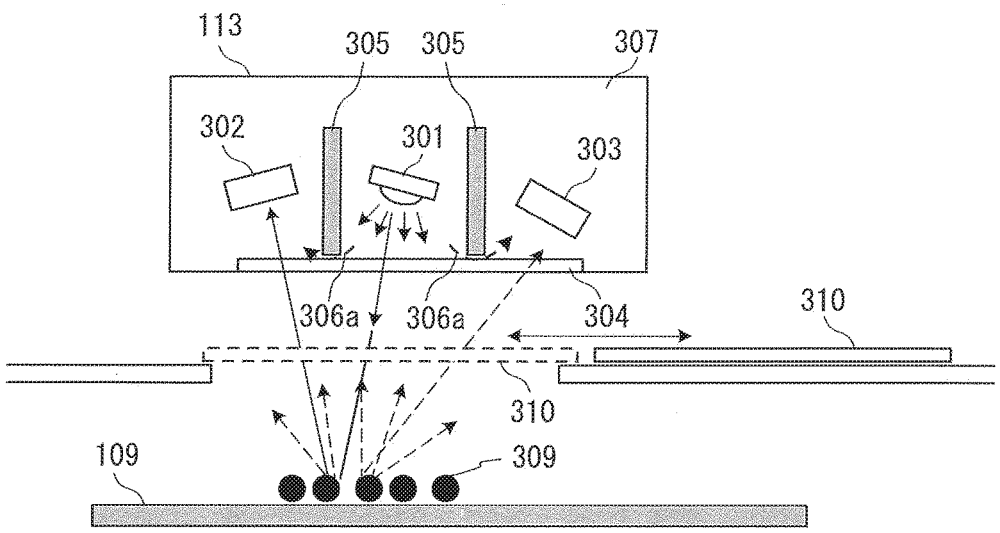
FIG. 4A and FIG. 4B are explanatory views of an optical sensor.
Figure 4B:
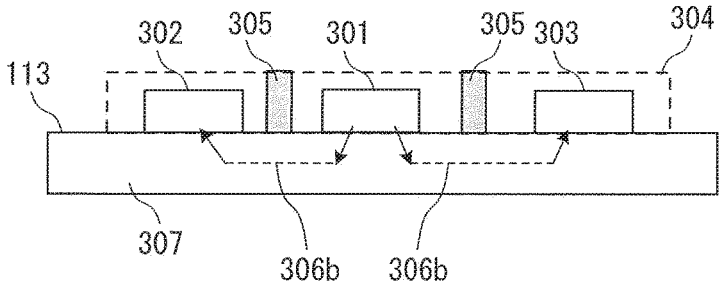

FIG. 4A and FIG. 4B are explanatory views of the optical sensor 113. As described above, the optical sensor 113 is arranged to face the intermediate transfer belt 109, and is configured to detect an image density of a measurement image 309, which is a toner image for density correction formed on the intermediate transfer belt 109. The configuration of the optical sensor 113 is described with reference to FIG. 4A. FIG. 4A is a view of the optical sensor 113 as seen from an upstream side in the conveying direction of the intermediate transfer belt 109.

The optical sensor 113 includes a light emitting element 301, for example, alight emitting diode (LED), light receiving elements 302 and 303, for example, photodiodes, a lens 304, and shielding members 305. The light emitting element 301 is arranged at a position to irradiate the intermediate transfer belt 109 with infrared light at an angle of incidence of about 15°. The light receiving element 302 is configured to receive, at a position of a specular reflection angle, reflected light of the infrared light with which the light emitting element 301 has irradiated the intermediate transfer belt 109. The light receiving element 303 is configured to receive, at a position of a diffuse reflection angle, scattered light of the infrared light with which the light emitting element 301 has irradiated the intermediate transfer belt 109. The light emitting element 301 and the light receiving elements 302 and 303 are mounted on a substrate 307. The substrate 307 includes a light receiving circuit having a current-to-voltage conversion function of converting currents flowing through the light receiving elements 302 and 303 in accordance with amounts of received light into voltages. The light receiving circuit outputs, as a detected analog value, the voltage obtained by the conversion by the current-to-voltage conversion function. Outputs of the light receiving elements 302 and 303 can be set, and a dynamic range of the detected analog value is determined depending on an output gain.

The lens 304 forms a light guiding path for the light with which the light emitting element 301 irradiates, and the light received by the light receiving elements 302 and 303. The lens 304 is formed of an epoxy resin, for example. The shielding members 305 are provided between the light emitting element 301 and the light receiving element 302, and between the light emitting element 301 and the light receiving element 303, respectively. The shielding members 305 are configured to prevent the light with which the light emitting element 301 irradiates from being directly received by the light receiving elements 302 and 303. The shielding members 305 are formed of a black resin, for example.

A shutter 310 is provided between the optical sensor 113 and the intermediate transfer belt 109. The shutter 310 takes a state (open state) indicated by the solid line when the image density of the measurement image 309 is measured. The shutter 310 takes a state (closed state) indicated by the broken line when the image density of the measurement image 309 is not measured. The shutter 310 is configured to move to a position between the lens 304 and the intermediate transfer belt 109 by taking the closed state, to thereby prevent soiling of the lens 304 with the toner and the like.

The optical sensor 113 having the above-mentioned configuration is capable of measuring the image density with both specularly reflected light and diffusely reflected light. When the measurement image 309 is formed on the intermediate transfer belt 109, the light receiving element 302, which receives the specularly reflected light, receives a reduced amount of specularly reflected light in accordance with the image density of the measurement image 309. The light receiving element 303 receives minute amounts of diffusely reflected light from the intermediate transfer belt 109 and the black measurement image, and large amounts of diffusely reflected light from the measurement images of yellow, magenta, and cyan, which are chromatic colors. As an area density of the toners of the chromatic colors becomes higher, the amounts of diffusely reflected light also become larger, and the amount of received light of the light receiving element 303 becomes larger. The density correction is performed through measuring the image densities of the measurement images of the chromatic colors using the specularly reflected light and the diffusely reflected light, and adjusting an image forming condition based on the measurement results. The image forming condition is an intensity of laser light of the exposure device 105, for example. In order to correct a density of an output image, the image forming apparatus 100 adjusts the image forming condition with the CPU 401. The image forming condition may be a charging bias supplied to the charging device 104 for the charging device 104 to charge the photosensitive drum 103, for example. Further, the image forming condition may be a developing bias voltage applied to the developing device 106 to control a potential difference between the photosensitive drum 103 and the developing device 106, for example.

Leak light from the light emitting element 301 to the light receiving elements 302 and 303 is described with reference to FIG. 4A and FIG. 4B. The leak light is light directly received by the light receiving elements 302 and 303 other than the reflected light from the intermediate transfer belt 109 and the measurement image 309. As illustrated in FIG. 4A, the shielding members 305 have the structure that abuts the lens 304, but in view of an assembly tolerance of the components, are difficult to completely shield light. Therefore, the light with which the light emitting element 301 irradiates disadvantageously passes through a gap between the shielding members 305 and the lens 304 (arrows 306*a*) to be received by the light receiving elements 302 and 303. Moreover, FIG. 4B is a schematic view of the optical sensor 113 as seen from the intermediate transfer belt 109 side. The leak light may also enter the inside of the substrate 307 from the light emitting element 301 to be received by the light receiving elements 302 and 303 (arrows 306*b*). In this manner, the light received by the light receiving elements 302 and 303 disadvantageously includes the reflected light from the intermediate transfer belt 109 and the leak light.

Figure 5:
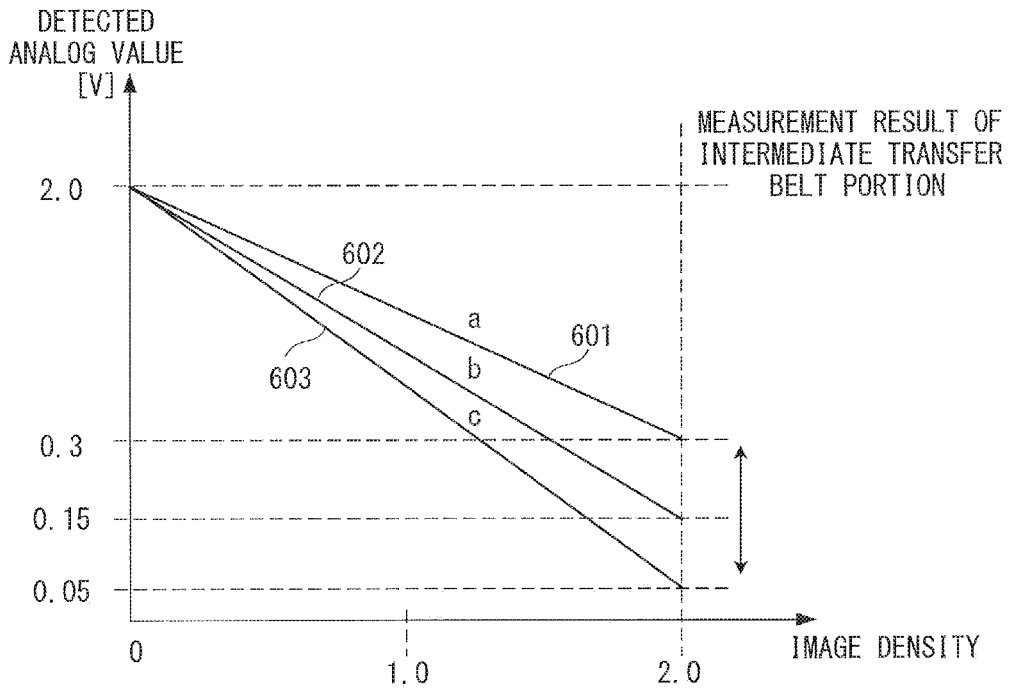
FIG. 5 is a graph of characteristics of optical sensors.

FIG. 5 is a graph of characteristics of three optical sensors 113 having different amounts of the leak light in a case where the optical sensors 113 are controlled such that the detected analog value is kept constant within a predetermined range. In FIG. 5, the vertical axis indicates the detected analog value, and the horizontal axis indicates the image density of the image formed on the intermediate transfer belt 109. An emission intensity of the light emitting element 301 is controlled such that the detected analog value becomes a predetermined value, and hence the results (detected analog values 601 to 603) of measuring the amounts of reflected light from the intermediate transfer belt 109 by the three optical sensors have the same value (2.0 V in this case). However, when the image density of the image formed on the intermediate transfer belt 109 becomes higher, the three detected analog values 601 to 603 are different due to the effect of the leak light of the optical sensors. In other words, the three optical sensors 113 have different sensitivity characteristics with respect to the image density. In the example of FIG. 5, when an image having an image density of "2.0" is formed on the intermediate transfer belt 109, a difference of 0.25 V at the maximum is generated among the detected analog values 601 to 603 of the three optical sensors 113.

Figure 6:
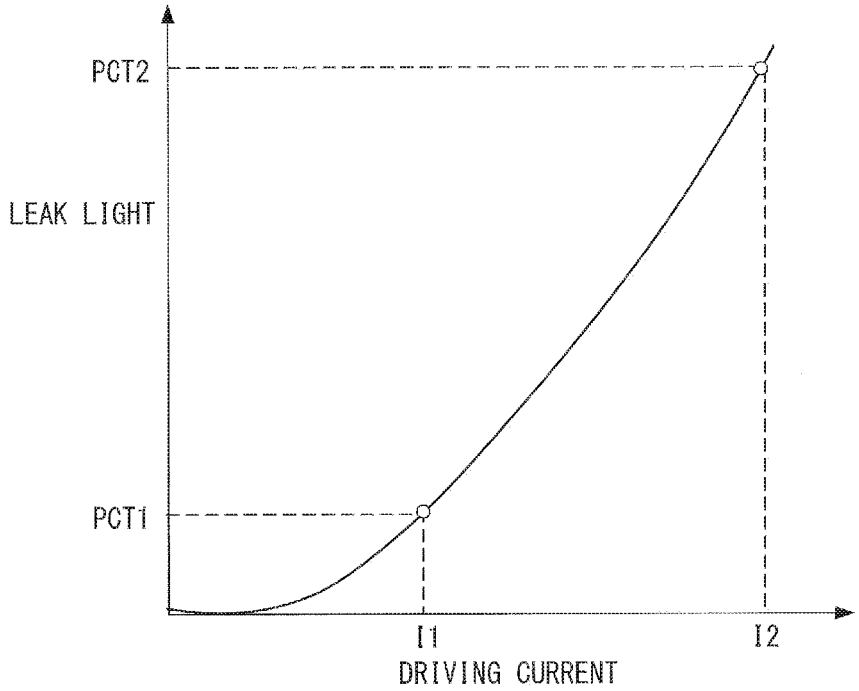
FIG. 6 is a graph of a relationship between an amount of light emission and an amount of leak light.

Further, experiments have shown that an amount of leak light is disadvantageously increased when a driving current of the light emitting element 301 is increased or the output gains of the light receiving elements 302 and 303 are increased to suppress the effect of the toner soil. In FIG. 6, there is shown experiment data indicating a relationship between the driving current of the light emitting element 301 and the amount of leak light. The image forming apparatus 100 stores in advance such experiment data as in FIG. 6, for example, in the memory 402. In the following description, the graph of the relationship between the driving current of the light emitting element 301 of the optical sensor 113 and the amount of leak light is referred to as profile data. When the driving current of the light emitting element 301 is increased and hence an amount of light emission is increased, the amount of leak light is increased. Therefore, with the increase in the amount of leak light, characteristics of the output value of the optical sensor 113 and a detected density are changed. This means that, even when the sensitivity characteristic of the optical sensor 113 before the amount of light adjustment is executed is the detected analog value 601 (FIG. 5), the sensitivity characteristic of the optical sensor 113 after the amount of light adjustment is executed is changed to the detected analog value 603 (FIG. 5), for example.

Next, the amount of light adjustment of the optical sensor 113 is described. When the change with time of the intermediate transfer belt 109 proceeds, a reflectance of a surface of the intermediate transfer belt 109 is reduced as a whole due to contaminants, such as paper dust. With the reduction in reflectance, the detected analog value of the optical sensor 113 is reduced, and a dynamic range in measuring the image density is reduced. To address this problem, the optical sensor 113 needs to adjust the amount of light with which to irradiate the intermediate transfer belt 109, to thereby adjust the detected analog value.

Figure 7A:
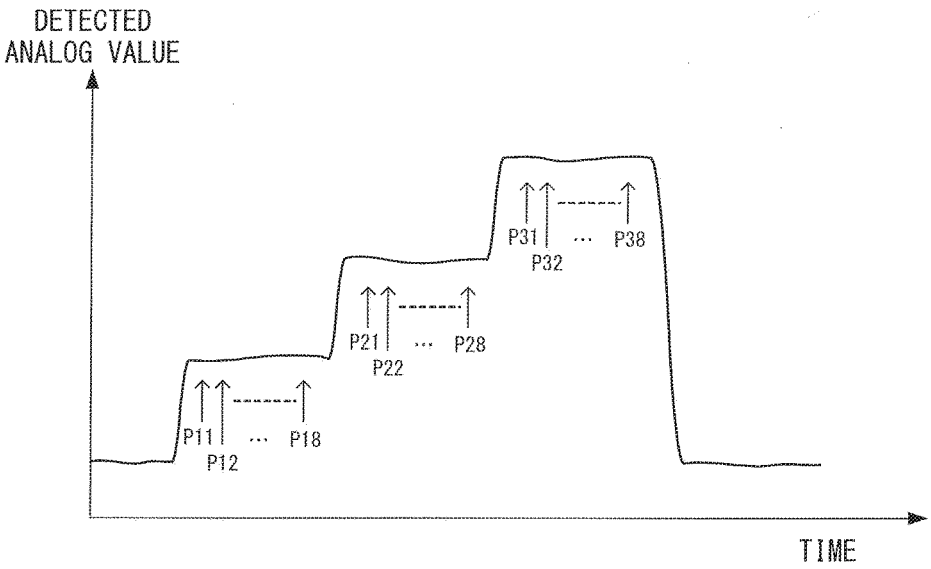
FIG. 7A and FIG. 7B are explanatory graphs for showing setting of a target amount of light.
Figure 7B:
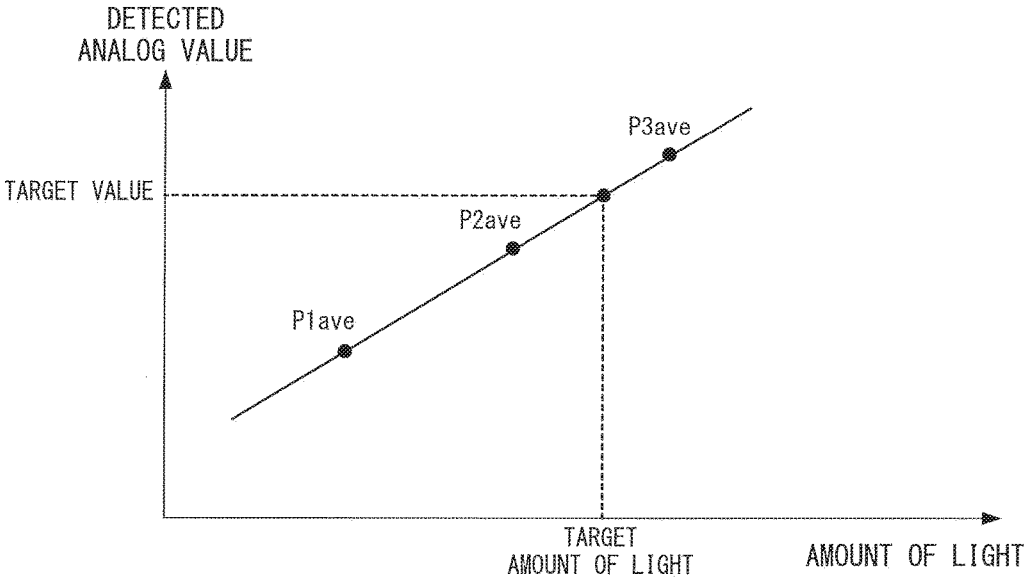

FIG. 7A and FIG. 7B are explanatory graphs for showing setting of a target amount of light by the amount of light adjustment. The light emitting element 301 of the optical sensor 113 is changed in amount of emitted light based on the driving current applied based on an instruction from the CPU 401.

The CPU 401 changes an amount of the driving current of the light emitting element 301 in three levels during the amount of light adjustment. As a result, the light emitting element 301 emits amounts of light of three levels. In FIG. 7A, there is shown a waveform of detected analog values output from the light receiving element 302 when the amount of light of the light emitting element 301 is changed in three levels and the reflected light from the intermediate transfer belt 109 is received by the light receiving element 302. In FIG. 7A, the optical sensor 113 outputs detected analog values P11 to P18 when the light emitting element 301 is caused to emit light based on an amount $I_A$ of the driving current. Similarly, the optical sensor 113 outputs detected analog values P21 to P28 when the light emitting element 301 is caused to emit light based on an amount $I_B$ of the driving current. The optical sensor 113 outputs detected analog values P31 to P38 when the light emitting element 301 is caused to emit light based on an amount $I_C$ of the driving current. A relationship of the amounts of the driving currents is expressed as $I_A<I_B<I_C$.

In FIG. 7B, there is shown a method of determining the target amount of light after the amount of light adjustment. The CPU 401 is configured to determine an amount of the driving current for outputting the detected analog value corresponding to the target amount of light based on the detected analog value acquired from the light receiving element 302. The CPU 401 is configured to cause the light emitting element 301 to emit light based on the amounts of the driving current of the three levels ($I_A$, $I_B$, and $I_C$), and to acquire three detected analog values corresponding to the reflected light from the intermediate transfer belt 109. In FIG. 7B, the CPU 401 acquires an average value P1ave of the detected analog values P11 to P18, an average value P2ave of the detected analog values P21 to P28, and an average value P3ave of the detected analog values P31 to P38.

As shown in FIG. 7B, the CPU 401 is configured to linearly interpolate the three average values P1ave, P2ave, and P3ave, which are the three detected analog values. In the approximation straight line, an amount of light corresponding to a target value of the detected analog value is the target amount of light. The CPU 401 is configured to determine, as the amount of the driving current to be applied to the light emitting element 301, an amount of the driving current with which the light emitting element 301 emits the target amount of light. When the detected analog value is lower than the target value even when the driving current is at the maximum, the CPU 401 switches an output gain of the optical sensor 113, and performs the amount of light adjustment again. The switching of the output gain is a well-known technology, and hence a description thereof is omitted here.

Density Correction Processing

Figure 8:
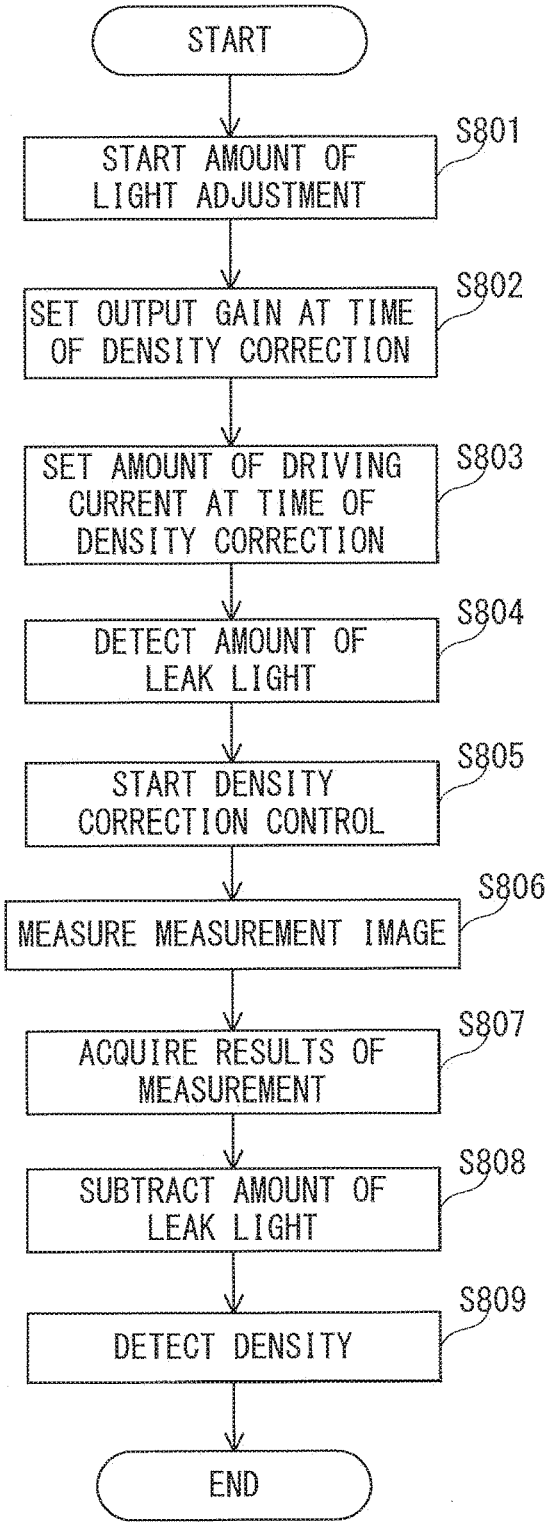
FIG. 8 is a flow chart for illustrating density correction processing.

With the amount of light adjustment of the optical sensor 113, the effect of the change in surface state of the intermediate transfer belt 109 on the detection accuracy of the image density is reduced. However, with the amount of light adjustment, the amount of light and the output gain at the time of detecting the image density are changed, and the amount of leak light is changed as shown in FIG. 6. To address this problem, the CPU 401 of the image forming apparatus 100 needs to perform the density correction while suppressing the effect of the leak light. FIG. 8 is a flow chart for illustrating density correction processing with which the effect of the leak light is suppressed.

The CPU 401 starts the amount of light adjustment of the optical sensor 113, and sets the output gain and the amount of the driving current at the time of the density correction (Steps S801, S802, and S803). The CPU 401 detects the amount of leak light (Step S804). The amount of leak light is detected based on the profile data shown in FIG. 6. For example, before assembly of the image forming apparatus 100, the CPU 401 uses the optical sensor 113 to measure an amount of leak light for a predetermined driving current in advance, and stores the measurement result as the profile data in the memory 402. As illustrated in FIG. 4A, the optical sensor 113 includes the light receiving element 302 configured to receive the specularly reflected light, and the light receiving element 303 configured to receive the diffusely reflected light. To this end, the memory 402 stores, for driving currents I1 and I2, amounts of leak light PCT1 and PCT2 for detecting an amount of leak light that is generated in the light receiving element 302, and amounts of leak light SCT1 and SCT2 for detecting an amount of leak light that is generated in the light receiving element 303. The amounts of leak light PCT1, PCT2, SCT1, and SCT2 are detected analog values of the light receiving elements 302 and 303 that have received the leak light.

Based on the measurement results of the amounts of leak light (driving currents I1 and I2, amounts of leak light PCT1 and PCT2, and amounts of leak light SCT1 and SCT2), which have been stored in the memory 402 in advance, the CPU 401 detects amounts of leak light at the time of the density correction. The detection of the amounts of leak light is performed by the following equations, for example. The amounts of leak light are an amount of specularly reflected leak light PCTx that is generated in the light receiving element 302, which receives the specularly reflected light, and an amount of diffusely reflected leak light SCTx that is generated in the light receiving element 303, which receives the diffusely reflected light.

Calculation of the Amount of Specularly Reflected Leak Light $$PCTx=(A\times Ix+B)\times \mathrm{GAIN}Px$$

$$A=(PCT2-PCT1)/(I2-I1)$$

$$B=PCT1-A\times I1$$

Ix: Amount of the driving current at the time of the density correction

GAINPx: Specular reflection output gain at the time of the density correction (output gain of the light receiving element 302)

Calculation of the Amount of Diffusely Reflected Leak Light $$SCTx=(C\times Ix+B)\times \mathrm{GAIN}Sx$$

$$C=(SCT2-SCT1)/(I2-I1)$$

$$D=SCT1-C\times I1$$

Ix: Amount of the driving current at the time of the density correction

GAINSx: Diffuse reflection output gain at the time of the density correction (output gain of the light receiving element 303)

Alternatively, the amounts of leak light PCTx and SCTx may be detected by storing in advance a table for showing the relationship of FIG. 6 as the profile data in the memory 402, and referring to the table.

After detecting the amounts of leak light, the CPU 401 starts the density correction control (Step S805). After starting the density correction control, the CPU 401 forms measurement images for density correction with the respective image forming stations Y, M, C, and K. As a result, the measurement images for density correction are formed on the intermediate transfer belt 109. The CPU 401 acquires, from the optical sensor 113, results of measuring the measurement image by the light receiving elements 302 and 303 (Steps S806 and S807). As a result, the CPU 401 acquires the detected analog value obtained by the specular reflection of the measurement image, and the detected analog value obtained by the diffuse reflection of the measurement image. The CPU 401 subtracts the amount of leak light, which has been detected in Step S804, from the acquired detected analog values, and detects the image density of the measurement image depending on a result of the subtraction (Steps S808 and S809). The CPU 401 determines the image density of the measurement image by the following equation, for example.

$$(\text{Image density})=Pxr-\alpha x(\mathrm{GAIN}Px/\mathrm{GAIN}Sx)\times Sxr$$

$$Pxr=Px-PCTx$$

$$Sxr=Sx-SCTx$$

α: Ratio of analog output values corresponding to the diffusely reflected light mixed in analog output values corresponding to the specularly reflected light under a predetermined condition (calculation method is described later)

Figure 9:
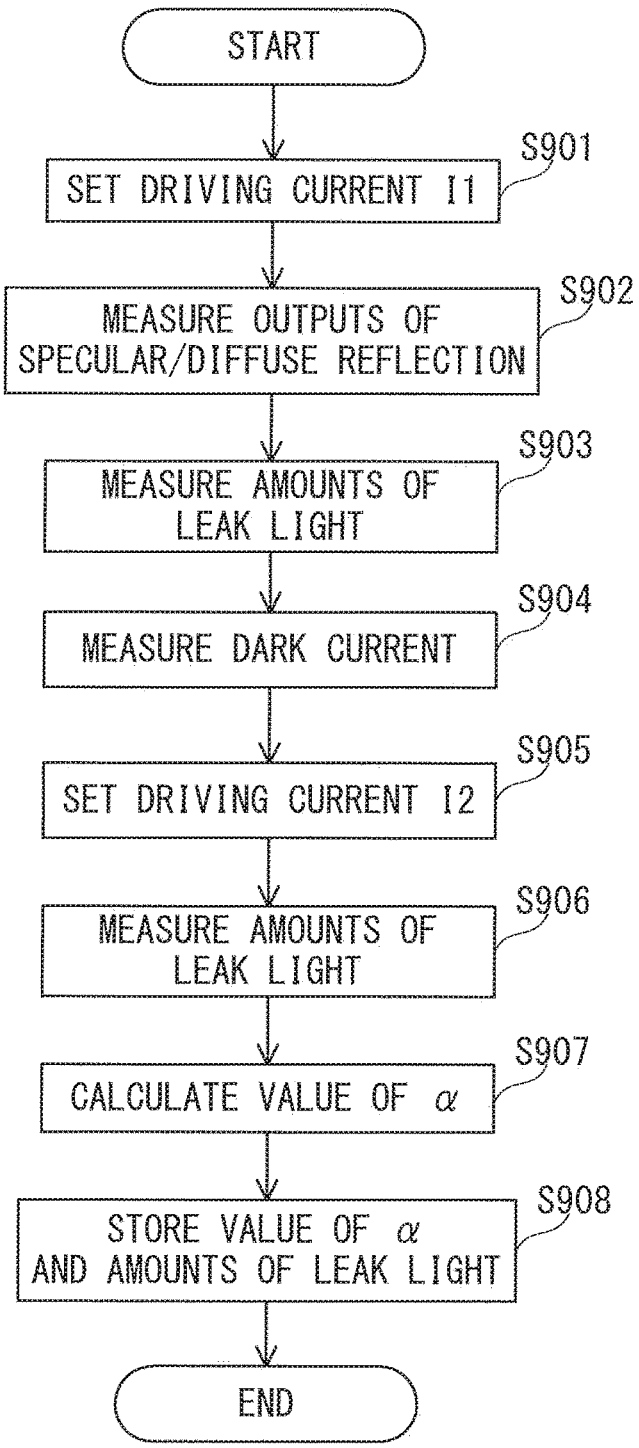
FIG. 9 is a flow chart for illustrating processing of measuring characteristic values of the optical sensor.

Px: Detected analog value obtained by the specular reflection of the measurement image Sx: Detected analog value obtained by the diffuse reflection of the measurement image The amounts of leak light PCT1, PCT2, SCT1, and SCT2 for the two driving currents I1 and I2 of the light emitting element 301, and the ratio α used in calculating the image density are measured in advance independently for the optical sensor 113. FIG. 9 is a flowchart for illustrating processing of measuring those characteristic values of the optical sensor 113. This processing is performed before the assembly of the image forming apparatus 100. The optical sensor 113 is connected to a measuring instrument for measuring the characteristic values.

The measuring instrument sets the driving current I1 of the light emitting element 301 (Step S901). The optical sensor 113 measures the specularly reflected light and the diffusely reflected light from an object that is located at a measurement position and that diffusely reflects light. The optical sensor 113 outputs, from the light receiving element 302, a detected analog value P corresponding to the specularly reflected light, and outputs, from the light receiving element 303, a detected analog value S corresponding to the diffusely reflected light. The measuring instrument acquires the detected analog values P and S from the optical sensor 113 (Step S902). Subsequently, the optical sensor 113 measures amounts of leak light PCT1 and SCT1 corresponding to the driving current I1 under a state in which the object is removed from the measurement position and in which reflected light is not generated (Step S903). The amounts of leak light PCT1 and SCT1 are detected analog values corresponding to the driving current I1 from the light receiving elements 302 and 303. The measuring instrument acquires the amounts of leak light PCT1 and SCT1 from the optical sensor 113. Subsequently, the measuring instrument sets the driving current to "0", and measures a dark current of the light emitting element 301 (Step S904).

The measuring instrument sets the driving current I2 of the light emitting element 301 (Step S905). The driving current I2 has an amount of current that is larger than the driving current I1. The optical sensor 113 measures amounts of leak light PCT2 and SCT2 corresponding to the driving current I2 under the state in which the object is removed from the measurement position and in which reflected light is not generated (Step S906). The amounts of leak light PCT2 and SCT2 are detected analog values corresponding to the driving current I2 from the light receiving elements 302 and 303. The measuring instrument acquires the amounts of leak light PCT2 and SCT2 from the optical sensor 113.

The measuring instrument calculates α based on the detected analog values P and S, the amounts of leak light PCT1 and SCT1, the dark current, and the amounts of leak light PCT2 and SCT2 that have been acquired (Step S907). In this case, the measuring instrument calculates α with the dark current being set to "0". The ratio α is calculated by the following equation, for example.

$$\alpha=(P-PCT1)/(S-SCT1)$$

The measuring instrument stores the calculated ratio α and the acquired amounts of leak light PCT1, SCT1, PCT2, and SCT2 in the memory 402. This completes the processing of measuring the characteristic values of the optical sensor 113.

The detected analog value of the optical sensor 113 may fluctuate depending on temperature characteristics of the light emitting element 301 and the light receiving elements 302 and 303. Therefore, the image forming apparatus 100 can measure the measurement image more accurately when the fluctuation of the detected analog value is corrected in accordance with an ambient temperature. The image forming apparatus 100 stores a temperature characteristic of the detected analog value in the memory 402, and corrects the detected analog value output from the optical sensor 113 in accordance with the temperature characteristic.

Figure 10:
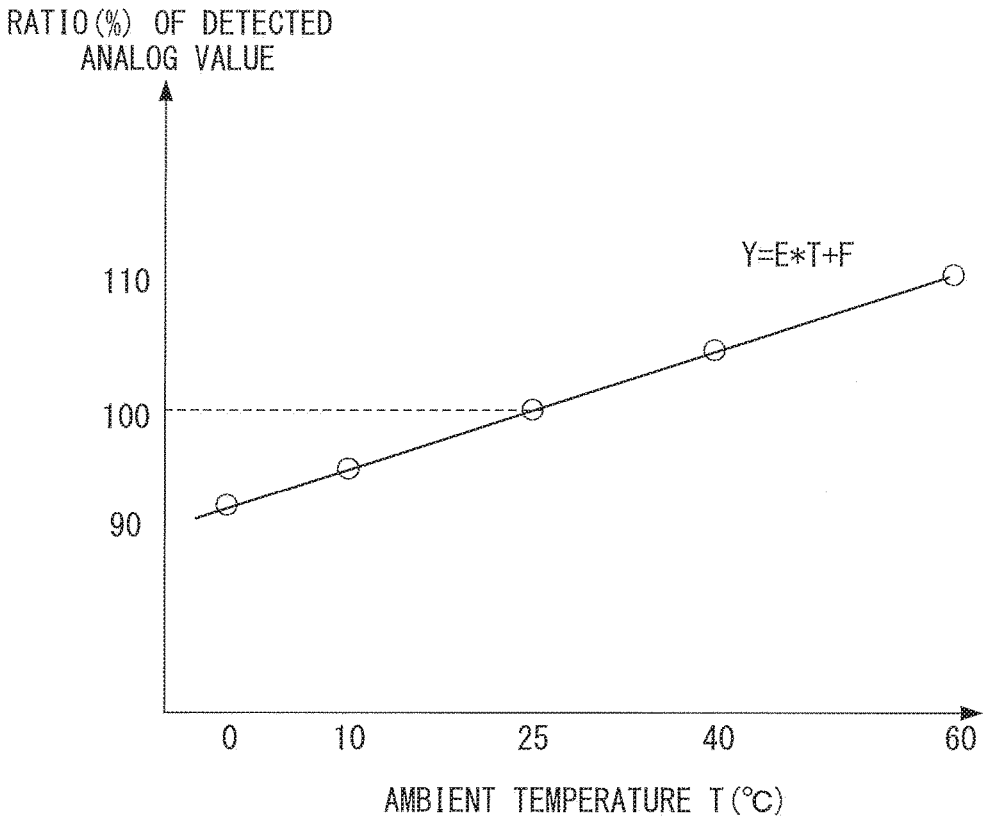
FIG. 10 is a graph of a characteristic of the optical sensor depending on an ambient temperature.

FIG. 10 is a graph of a characteristic of the optical sensor 113 depending on an ambient temperature. In FIG. 10, there is shown, with a detected analog value of the optical sensor 113 at a time when the ambient temperature is a predetermined temperature (25° C. in this case) being set to 100%, detected analog values at other ambient temperatures as temperature ratios. This temperature ratio is an example of the temperature characteristic. The ambient temperature of the optical sensor 113 is detected by the thermistor 114.

The image forming apparatus 100 stores in the memory 402 in advance a relationship between a temperature ratio Y of the detected analog value and an ambient temperature T, which is exemplified in FIG. 10. In FIG. 10, the relationship between the temperature ratio Y of the detected analog value and the ambient temperature T has linearity expressed as the equation: Y=E×T+F. In the equation, E and F are constants calculated based on actually measured values of the temperature ratio Y of the detected analog value and the ambient temperature T.

The CPU 401 corrects the detected analog value obtained from the measurement image by the following equations based on the ambient temperature T detected by the thermistor 114 and the temperature ratio Y of the detected analog value acquired from the optical sensor 113 in accordance with the above-mentioned relationship stored in the memory 402.

$$Pxr=(Px-PCTx)\times(E\times Tx+F)/100$$

$$Sxr=(Sx-SCTx)\times(E\times Tx+F)/100$$

Pxr: Detected analog value obtained by the specular reflection after the correction Sxr: Detected analog value obtained by the diffuse reflection after the correction Px: Detected analog value obtained by the specular reflection of the measurement image Sx: Detected analog value obtained by the diffuse reflection of the measurement image Tx: Ambient temperature The image forming apparatus 100 having the above-mentioned configuration enables the measurement of the image density of the measurement image in consideration of the leak light. In this embodiment, the image forming apparatus 100 detects the image density of the measurement image based on the amount of leak light, which is detected based on the profile data, and the detected analog value. Therefore, the image forming apparatus 100 can measure the image density of the measurement image more accurately than in the related art while suppressing the change in sensitivity characteristic of the optical sensor 113 caused by the leak light, and perform the density correction with high accuracy. Moreover, the image forming apparatus 100 can measure the image density of the measurement image optimally depending on the individual difference in amount of leak light of the optical sensor 113, the change with time of the optical sensor 113, the fluctuation of the amount of leak light corresponding to the amount of light emission, and the fluctuation of the ambient temperature of the optical sensor 113.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. Further, embodiment(s) of the present invention can also be realized by a computer of a system or apparatus that includes one or more circuits (e.g., application specific integrated circuit (ASIC) or SOC (system on a chip)) for performing the functions of one or more of the above-described embodiment(s). The computer may comprise one or more processors (e.g., central processing unit (CPU), micro processing unit (MPU)) and may include a network of separate computers or separate processors to read out and execute the computer executable instructions.

This application claims the benefit of Japanese Patent Application No. 2016-206276, filed Oct. 20, 2016 which is hereby incorporated by reference herein in its entirety.

What is claimed is:

1. An image forming apparatus, comprising:

an image former configured to form an image on a sheet based on an image forming condition;

a transfer belt, onto which the image former forms a measurement image;

a sensor, including a substrate, a light emitting element provided on the substrate, a light receiving element provided on the substrate, and a shielding member provided between the light emitting element and the light receiving element on the substrate, and configured to measure a reflected light from the measurement image on the transfer belt and output a signal value according to an intensity of the reflected light, wherein the light emitting element is configured to emit a light based on a driving current;

a memory configured to store reference data related to a relationship between a plurality of driving currents and a plurality of correction values, wherein the reference data is used for correcting an error of the signal value occurred by a leak light of the sensor;

a controller configured to:

perform a driving current control in which the driving current is adjusted;

control the light emitting element of the sensor based on the driving current adjusted in the driving current control to obtain a measurement image signal value corresponding to the reflected light from the measurement image;

determine a correction value from the driving current adjusted in the driving current control based on the reference data stored in the memory; and control the image forming condition based on the correction value and the measurement image signal value.

2. The image forming apparatus according to claim 1, wherein the light receiving element receives specularly reflected light.

3. The image forming apparatus according to claim 1, wherein the light receiving element comprises a first light receiving element configured to receive specularly reflected light, and a second light receiving element configured to receive diffusely reflected light.

4. The image forming apparatus according to claim 1, wherein the light receiving element comprises a first light receiving element configured to receive specularly reflected light, and a second light receiving element configured to receive diffusely reflected light, and wherein the correction value comprises first correction value for the first light receiving element, and second correction value for the second light receiving element.

5. The image forming apparatus according to claim 1, wherein the image forming condition corresponds to a condition for adjusting a density of an image to be formed by the image former.

6. The image forming apparatus according to claim 1, further comprising a temperature detector, wherein the controller is configured to control the image forming condition based on the measurement image signal value, the correction value, and a temperature detected by the temperature detector.

7. The image forming apparatus according to claim 1, wherein the controller is configured to adjust the driving current based on a transfer belt signal value corresponding to the reflected light from the transfer belt, in the driving current control.

8. A sensor assembly, comprising:

a substrate;

a light emitting element provided on the substrate, and configured to emit a light based on a driving current;

a first light receiving element provided on the substrate, and configured to output a first output value based on a light receiving result of the first light receiving element;

a second light receiving element provided on the substrate, and configured to output a second output value based on a light receiving result of the second light receiving element;

a shielding member including a first shield provided between the light emitting element and the first light receiving element on the substrate, and a second shield provided between the light emitting element and the second light receiving element;

a memory configured to store first reference data related to a relationship between the driving current and the first output value corresponding to a light receiving result of a leak light by the first light receiving element, and second reference data related to a relationship between the driving current and the second output values corresponding to a light receiving result of the leak light by the second light receiving element;

a controller configured to:

perform a driving current control in which the driving current is adjusted;

determine a first correction value for correcting an error of the first output value occurred by a leak light from the first reference data based on the adjusted driving current adjusted in the driving current control; and determine a second correction value for correcting an error of the second output value occurred by the leak light from the second reference data based on the adjusted driving current.

9. The sensor assembly according to claim 8, wherein the first reference data includes a reference first output value corresponding to a first driving current, and another reference first output value corresponding to a second driving current different from the first driving current, wherein the second reference data includes a reference second output value corresponding to the first driving current, and another reference second output value corresponding to the second driving current.

10. The sensor assembly according to claim 8, wherein the first light receiving element receives a specularly reflected light, and wherein the second receiving element receives a diffusely reflected light.

11. The sensor assembly according to claim 8, wherein the sensor assembly measures a toner image formed by a printer.

* * * * *